United States Patent [19]

Fukae

[11] Patent Number: 4,475,525

[45] Date of Patent: Oct. 9, 1984

[54] ORIFICE OF EXHAUST GAS RECIRCULATION SYSTEM

[75] Inventor: Yasuo Fukae, Yokohama, Japan

[73] Assignee: Nissan Motor Company, Limited, Japan

[21] Appl. No.: 550,356

[22] Filed: Nov. 10, 1983

[30] Foreign Application Priority Data

Nov. 16, 1982 [JP] Japan ..... 57-200929

[51] Int. Cl.[3] ..... F02M 25/06

[52] U.S. Cl. ..... 123/568; 123/570

[58] Field of Search ..... 123/568, 570

[56] References Cited

U.S. PATENT DOCUMENTS 4,151,715 5/1979 Tachibana et al. ..... 123/568 X

*Primary Examiner*—Wendell E. Burns

*Attorney, Agent, or Firm*—Leydig, Voit, Osann, Mayer and Holt, Ltd.

[57] ABSTRACT

In an exhaust gas recirculation system for an internal combustion engine, orifices disposed in a passage for recirculating the exhaust gas is made of a sheet of a bimetal or other material capable of changing from a normal shape to a deformed shape when the heat of the exhaust gas is applied, in order to prevent carbon contained in the exhaust gas from depositing on the orifices.

5 Claims, 6 Drawing Figures

ORIFICE OF EXHAUST GAS RECIRCULATION SYSTEM

BACKGROUND OF THE INVENTION

The present invention relates to an exhaust gas recirculation system of an internal combustion engine, and more specifically to orifices disposed in a passage for recirculating the exhaust gas.

Unburnt carbon or other substances contained in the exhaust gas tend to stick to and deposit on an orifice disposed in an exhaust gas recirculation passage, and tend to decrease the opening size of the orifice with the passage of time. This undesired variation of the orifice opening size changes the amount of EGR and the distribution of the EGR gas among the cylinders of the engine, and badly affects exhaust emission control and engine performance.

SUMMARY OF THE INVENTION

It is therefore an object of the present invention to provide an EGR system having an orifice which is not affected by carbon deposits or the like.

According to the present invention, an exhaust gas recirculation system comprises an orifice which is disposed in an exhaust gas recirculation passage, and which is made of a material capable of changing its shape when the temperature changes. The orifice may be made of a bimetal sheet capable of changing from a normal shape to a deformed shape when the heat of the exhaust gas is applied, and returning to the normal shape when the heat is not applied.

DETAILED DESCRIPTION OF THE INVENTION

Figure 1:
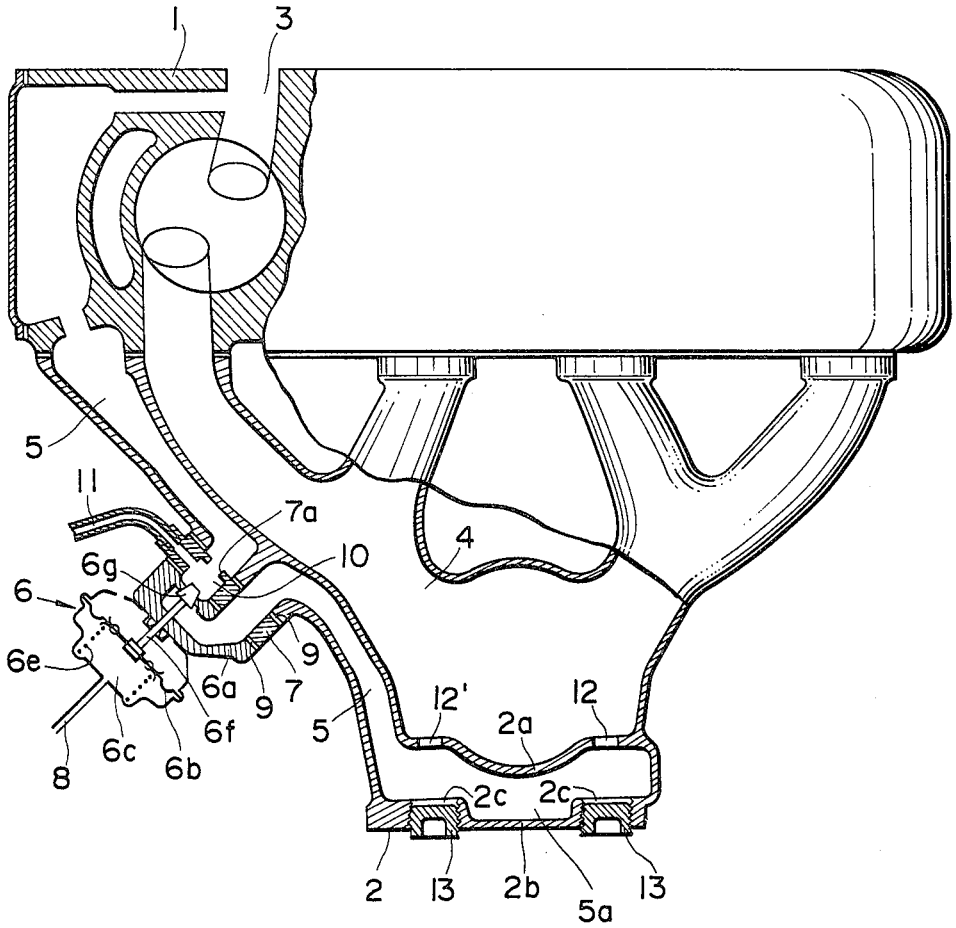
FIG.1 (PRIOR ART)
FIG. 1 is a sectional view of an exhaust gas recirculation passage having orifices of a conventional type.
Figure 2:
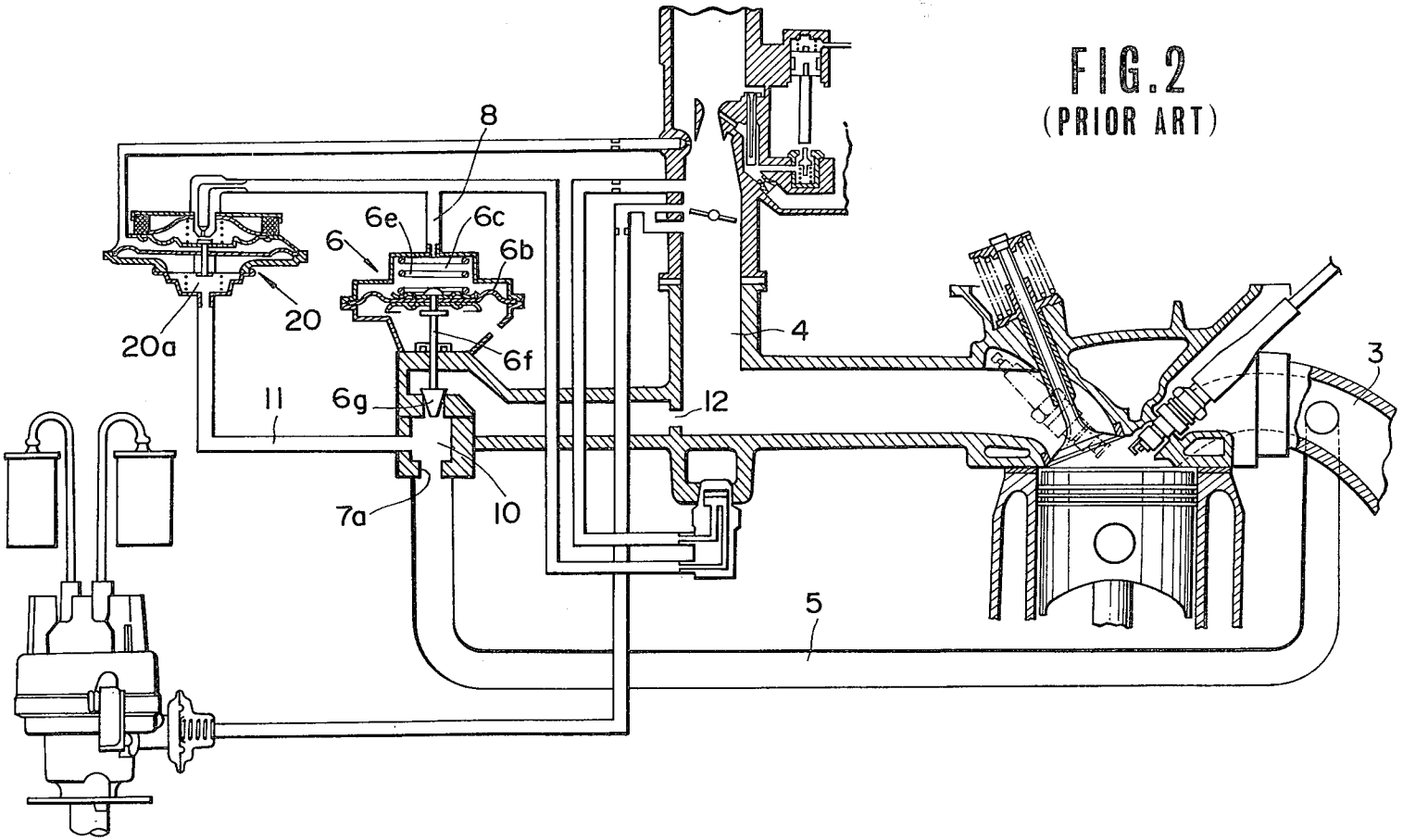
FIG. 2 (PRIOR ART)
FIG. 2 is a schematic view of an exhaust gas recirculation system including the portion of FIG. 1.

An exhaust gas recirculation system of a conventional type is shown in FIGS. 1 and 2. This system is known from U.S. Pat. No. 3,827,414. In a cylinder head 1 and an intake manifold 2, there is formed an exhaust gas recirculation passage 5 for recirculating a portion of the exhaust gas in an exhaust passage 3 back to an intake passage 4. In the exhaust gas recirculation passage 5, there is disposed an exhaust gas recirculation control valve 6 for controlling the amount of exhaust gas recirculation.

A casing **6*a* of the EGR control valve 6 is fixed to the intake manifold 2 with the interposition of a spacer 7. The spacer 7 has an orifice 7*a* which regulates the flow rate of the recirculated exhaust gas at an upstream position with respect to the EGR valve 6. Gaskets 9 are disposed on both sides of the spacer 7**.

The EGR valve 6 has a diaphragm **6*b*, and a control chamber 6*c* defined by the diaphragm 6*b*. The control chamber 6*c* is supplied with a controlled negative pressure through a negative pressure passage 8 from a negative pressure control unit 20 shown in FIG. 2. The diaphragm 6*b* moves in accordance with the negative pressure signal sent from the negative pressure control unit 20. A valve shaft 6*f* having a valve head 6*g* is connected to the diaphragm 6*b*. The valve opening degree is increased and decreased in accordance with the balance between the negative pressure signal and a force of a return spring 6*e***. The negative pressure is controlled in such a manner that the amount of exhaust gas recirculation is increased and decreased in accordance with the amount of intake air, and the amount of EGR is decreased during deceleration and idling, by way of example.

A back pressure chamber 10 is formed in the spacer 7 downstream of the orifice **7*a*. An exhaust gas pressure in the back pressure chamber 10 is introduced through a passage 11 to a back pressure chamber 20*a* of the negative pressure control unit 20 shown in FIG. 2, by way of example, to control the negative pressure to be sent to the EGR control valve 6** in a manner of a feedback control.

A partition wall **2*a* formed between an expansion chamber 5*a* of the EGR passage 5 and the intake passage 4 is formed with a plurality of orifices 12 and 12' for allowing the exhaust gas to flow from the expansion chamber 5*a* to the intake passage 4 at a controlled rate. In this example, there are two orifices 12 and 12'. The opening size of each orifice 12 or 12' is determined by experiments so as to provide a uniform distribution of the EGR gas among the cylinders of the engine. For example, it is preferable to make the opening size of the orifice 12 smaller than that of the orifice 12'** in consideration of the gas flow direction.

The orifices 12 and 12' are formed by drilling and/or reaming through holes **2*c* and 2*c* formed in an outside wall 2*b* of the expansion chamber 5*a* facing the partition wall 2*a*. The holes 2*c* and 2*c* are tightly closed by plugs 13 and 13**.

The thus constructed EGR system controls the amount of EGR by changing the opening degree of the EGR valve 6 in accordance with engine load, and by so doing efficiently reduces NOx emissions.

The recirculated exhaust gas contains unburned carbon derived from fuel and lubricating oil. Besides, the orifices 12, 12' are formed in a relatively thick wall of a casting (, whose wall thickness is almost equal to the thickness of the passage wall of the intake manifold 2). The thickness of the casting wall can not be made small. Accordingly, carbon attaches to and deposites on the inner peripheries of the orifices 12 and 12'. Carbon deposits around the openings of the orifices 12 and 12' decrease the opening sizes of the orifices, and the amount of EGR, so that the EGR system can no longer work properly to reduce NOx emission. In the case that there are a plurality of the orifices as in this example, the carbon deposits decrease the opening sizes of the orifices unequally, and cause uneven cylinder to cylinder distribution of EGR, which results in deteriorations of exhaust emission control and engine performance.

Figure 3:
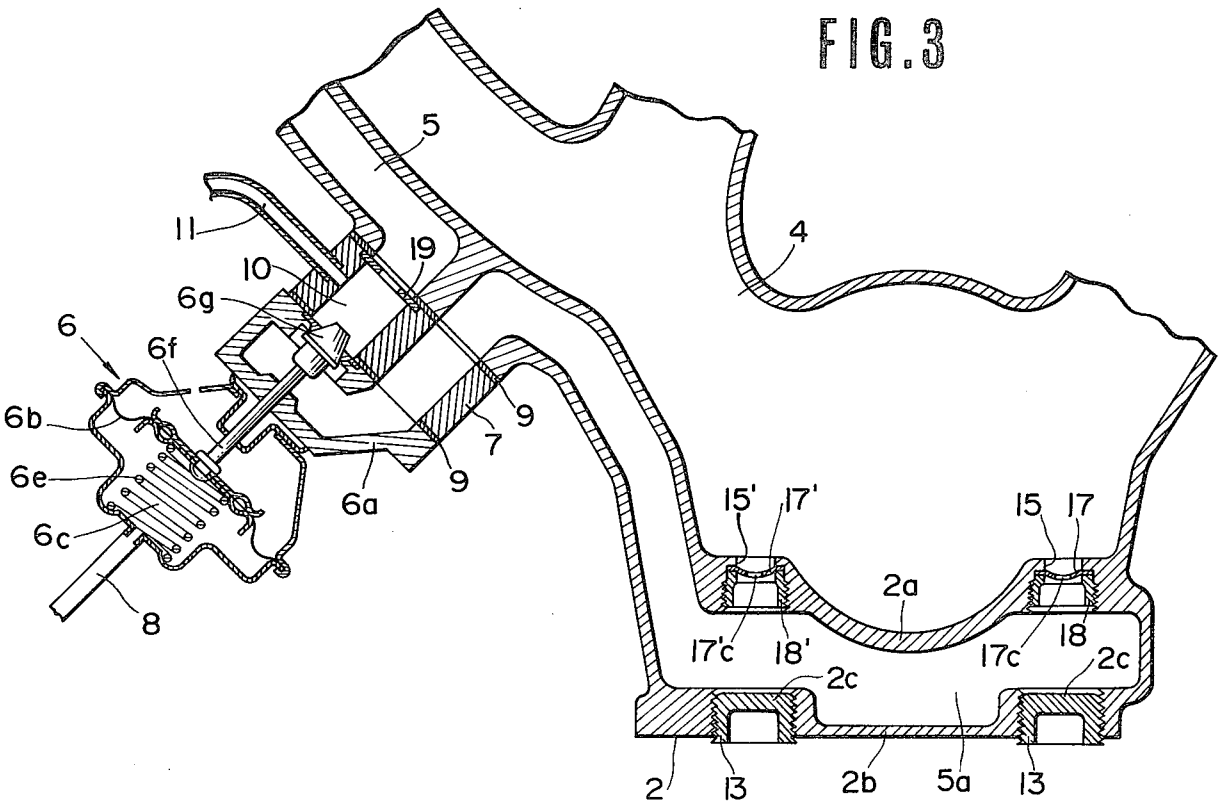
FIG. 3 is a sectional view of a main portion of the exhaust gas recirculation system according to the present invention.

FIG. 3 shows a main portion of one embodiment of the present invention. In FIG. 3, the same reference numerals are used to denote members equivalent to the members shown in FIGS. 1 and 2. In a partition wall **2*a* between an expansion chamber 5*a* of an exhaust gas recirculation passage 5 and an intake passage 4, there are formed a plurality of thick portions. In this embodiment, there are two thick portions. In each of the thick portions, a hole 15 or 15' is bored. Each of the holes 15 and 15' leads from the expansion chamber 5***a* to the intake passage 4. Each of the holes 15 and 15' has a shoulder. In this embodiment, each of the holes 15 and 15' is large in cross sectional area on the expansion chamber's side of the shoulder, and small on the intake passage's side.

Figure 4:
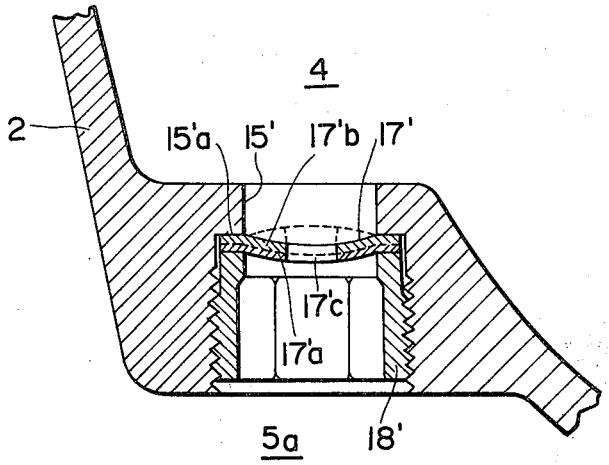
FIG. 4 is an enlarged sectional view of an orifice of FIG. 3.

FIG. 4 shows the hole 15' in detail. An orifice 17' is inserted into the hole 15' from the expansion chamber's side. The orifice 17' abuts on the shoulder 15'*a* of the hole 15'. A hollow fastening member 18' is screwed into the hole 15' from the expansion chamber's side. The rim of the orifice 17' is loosely clamped between the shoulder 15'*a* and the fastening member 18'. Since the orifice 17' is loosely clamped, the orifice 17' can readily change its shape.

The orifice 17' is made of a thin sheet of a bimetal consisting of dissimilar metals, with different coefficients of thermal expansion. The orifice 17' has a spherical central portion surrounded by the circular rim. The spherical portion is concave on one side and convex on the other side. A first metal 17'*a* of the bimetal having a smaller coefficient of thermal expansion is placed on the convex side, and a second metal 17'*b* having a larger coefficient of thermal expansion is placed on the concave side. Both metals are bonded together. The orifice 17' has an opening 17'*c* of a predetermined size in the center of the spherical portion. The orifice 17' of the bimetal has the shape shown by solid lines in FIG. 4 at unelevated temperature. When the heat of the exhaust gas is applied to the orifice 17', and the temperature reaches a predetermined temperature, the orifice 17' abruptly changes into an inverted shape shown by a broken line in FIG. 4, by the action of internal stresses.

Figure 5:
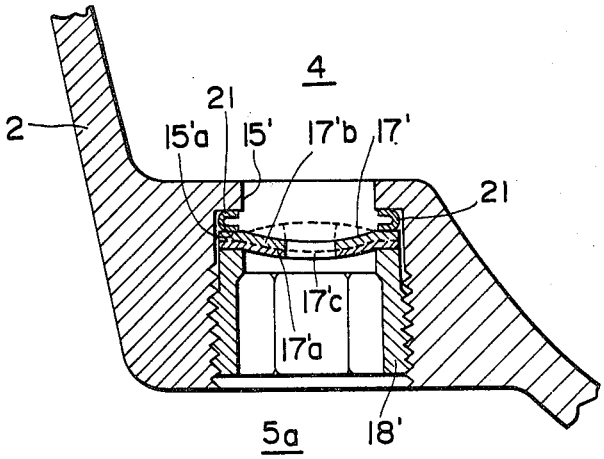
FIG. 5 is an enlarged sectional view similar to FIG. 4, showing another arrangement.

FIG. 5 shows another arrangement, in which a spring 21 of an annular shape is provided. The spring 21 is disposed on one side of the orifice 17'. The spring 21 and the rim of the orifice 17' are clamped between the shoulder 15'*a* and the fastening member 18'. With the spring 21, the orifice 17' can readily change its shape while the orifice 17' is not loose.

The hole 15 and its orifice 17 are basically the same in construction as the hole 15' and the orifice 17'.

It is possible to place the convex sides of the orifices 17 and 17' on either of the expansion chamber's side and the intake passage's side. However, it is preferable to make the same sides of the orifices 17 and 17' to face toward the same direction, because such an arrangement help make the EGR distribution in the intake passage uniform. The sizes of the openings 17*c* and 17'*c* are determined experimentally so as to provide uniform cylinder to cylinder distribution of the amount of EGR.

Figure 6:
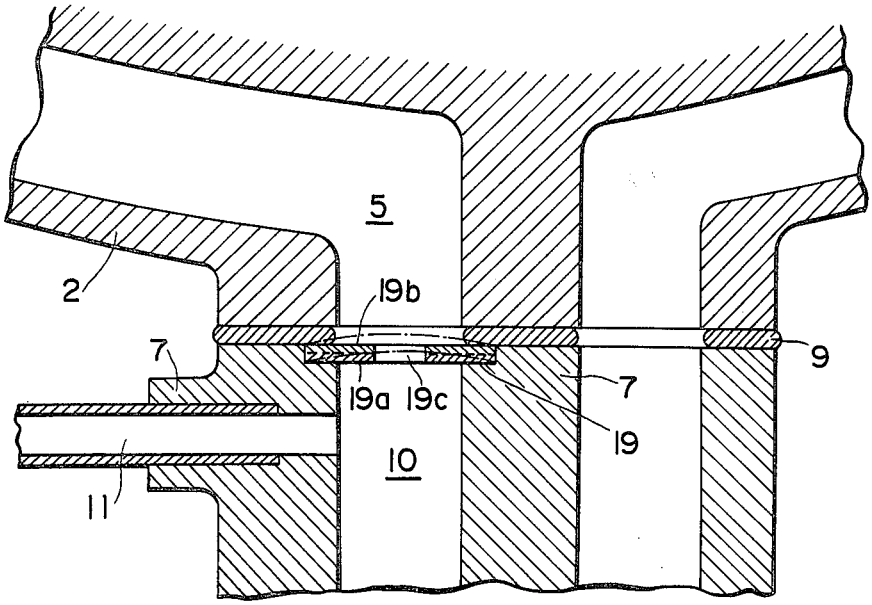
FIG. 6 is an enlarged sectional view of another orifice of FIG. 3, disposed upstream of an EGR control valve.

FIG. 6 shows another orifice 19 disposed in the EGR passage 5 upstrea of the EGR valve 6 A spacer 7 corresponding to the spacer 7 of FIG. 1 is fixed to the intake manifold 2 with a gasket 9 interposed therebetween. The orifice 19 is loosely clamped between the gasket 9 and the spacer 7 so that the orifice 19 can readily change its shape. It is optional to use a spring as in FIG. 5.

The orifice 19 is made of a thin sheet of a bimetal. A first metal 19*a* having a smaller coefficient of thermal expansion and a second metal 19*b* having a larger coefficient of thermal expansion are bonded together. The orifice 19 is formed in the shape of a circular disc. The orifice 19 has an opening 19*c* of a predetermined size in the center. The orifice 19 is in the shape of the circular disc at unelevated temperature. When the heat of the exhaust gas increases the temperature of the orifice 19 to a predetermined temperature, the orifice 19 bulges into a spherical shape shown by one-dot chain lines in FIG. 6 by the action of internal stresses. In this embodiment, the orifice 19 is placed in such a direction that the side which becomes convex at elevated temperatures faces upward as viewed in FIG. 6. However, it is possible to place the orifice 19 in the reversed position.

As to the rest, the EGR system of this embodiment is the same as the system of FIG. 1.

The thus constructed EGR system operates as follows: The EGR valve 6 controls the amount of the exhaust gas directed to the intake passage 4 through the exhaust gas recirculation passage 5 by changing the opening degree in accordance with engine load. The recirculated exhaust gas enters the expansion chamber 5*a* of the EGR passage 5, and then flows through the orifices 17 and 17' into the intake passage 4. As the temmperature of the bimetal orifices 17 and 17' is increased by the heat of the exhaust gas, internal stresses are accumulated in the bimetal orifices 17 and 17'. When the temperature reaches a predetermined value, the internal stresses of the concave side metals 17*b* and 17'*b* due to thermal expansion overcome the internal stresses of the convex side metals 17*a* and 17'*a* due to thermal expansion, and the orifices 17 and 17' abruptly change into the inverted shape shown by the broken line of FIG. 4. When the engine is stopped, and the temperature decreases below the predetermined temperature, the orifices 17 and 17' resumes the original shapes shown by the solid line in FIG. 4. Thus, the bimetal orifices 17 and 17' repeat alternation and restoration of shape with repetition of operation and rest of the engine.

The orifices 17 and 17' of bimetal sheet can be made thinner than the orifices 12 and 12' of FIG. 1, formed in the casting wall. Therefore, it is difficult for carbon to attach to the inner peripheries of the orifices 17 and 17'. If carbon deposits are formed around the orifices 17 and 17', the brittle carbon deposits can be easily removed by the impact of abrupt shape changes of the bimetal orifices. Thus, the orifices 17 and 17' are immune against aging of opening size due to carbon deposits, so that harmful influences on exhaust emission control and driveability can be prevented.

In this embodiment, the orifice 19 disposed upstream of the EGR valve 6 is also made of a bimetal. The orifice 19 is in the shape of a circular disc as shown by the solid lines in FIG. 6. When the temperature of the orifice 19 reaches a predetermined temperature, the orifice 19 changes into a shape whose central portion bulges spherically as shown by the one-dot chain line in FIG. 6. The orifice 19 returns to the circular disc shape when the temperature decreases. Thus, the orifice 19 alternates between the normal shape and the deformed shape as the engine alternates between the operating state and the rest state. By so doing, the orifice 19 prevents carbon and other component of the exhaust gas from sticking to and depositing on itself, and maintains its opening size unchanged. Because the opening size of the orifice 19 does not undergo aged deterioration, the orifice 19 can maintain an exhaust gas pressure characteristic of the back pressure chamber 10, and prevent undesired variation of the EGR amount. Thus, the orifice 19 as well as the orifices 17 and 17' can prevent bad influences of carbon deposits or the like on exhaust emission control and engine performance.

In place of a bimetal, the orifices 17, 17' and 19 may be made of a material which can change its shape in accordance with temperature change. For example, it is possible to make any or all of the orifices 17, 17' and 19 of a shape-memory alloy capable of returning to a certain shape when the temperature changes.

What is claimed is:

1. An exhaust gas recirculation system for an internal combustion engine, comprising an exhaust gas recirculation passage extending from an exhaust passage of the engine to an intake passage of the engine for recirculating the exhaust gas of the engine, and an orifice disposed in said exhaust gas recirculation passage, said orifice being made of a material capable of changing its shape in accordance with temperature change.

2. An exhaust gas recirculation system according to claim 1, wherein said orifice is made of a sheet of a bimetal.

3. An exhaust gas recirculation system according to claim 2, wherein said system comprises a plurality of first orifices which are disposed in a partition wall separating said intake passage from said exhaust recirculation passage, each of said first orifices being made of a bimetal sheet, each of said first orifices having a spherical central portion one side of which is concave, the other side of which is convex, and which has an opening in the center, the bimetal of each first orifice consisting of a first metal which has a smaller coefficient of thermal expansion and is placed on the convex side and a second metal which has a greater coefficient of thermal expansion and is placed on the concave side.

4. An exhaust gas recirculation system according to claim 3, further comprising an exhaust gas recirculation valve which is disposed in said exhaust gas recirculation passage for controlling an exhaust gas flow therethrough, and a second orifice which is disposed upstream of said exhaust gas recirculation valve, said second orifice being made of a sheet of a bimetal.

5. An exhaust gas recirculation system according to claim 4, wherein said second orifice has a shape of a flat circular disc having an opening in the center.

* * * * *